US011542076B2

(12) United States Patent
Guo et al.

(10) Patent No.: US 11,542,076 B2
(45) Date of Patent: Jan. 3, 2023

(54) CONTAINER

(71) Applicant: Koleto Innovations, LLC, Cypress, CA (US)

(72) Inventors: Christine Guo, Hangzhou (CN); Jason Qin, Shanghai (CN)

(73) Assignee: GREENLANE HOLDINGS INC., Boca Raton, FL (US)

( * ) Notice: Subject to any disclaimer, the term of this patent is extended or adjusted under 35 U.S.C. 154(b) by 0 days.

(21) Appl. No.: 17/166,924

(22) Filed: Feb. 3, 2021

(65) Prior Publication Data

US 2022/0242627 A1 Aug. 4, 2022

(51) Int. Cl.
*B65D 50/04* (2006.01)
*B65D 43/22* (2006.01)
*B65D 43/16* (2006.01)

(52) U.S. Cl.
CPC ..... *B65D 50/046* (2013.01); *B65D 43/163* (2013.01); *B65D 43/22* (2013.01)

(58) Field of Classification Search
CPC ..... B65D 50/046; B65D 43/163; B65D 43/22
USPC ..... 220/263
See application file for complete search history.

(56) References Cited

U.S. PATENT DOCUMENTS 4,365,711 A 12/1982 Long
6,454,115 B1 9/2002 Allasia
8,100,288 B2 1/2012 Giraud et al.
8,540,115 B2 9/2013 Giraud et al.
8,540,116 B2 9/2013 Giraud et al.
8,881,942 B2 11/2014 Giraud et al.
9,738,426 B1 8/2017 Giraud et al.
9,834,341 B2 12/2017 Giraud et al.
10,118,744 B2 11/2018 Giraud et al.
2011/0259783 A1 10/2011 Angelucci et al.
2013/0233753 A1 9/2013 Harvey et al.
2015/0021326 A1* 1/2015 Giraud ..... A61J 1/03 220/254.1
2017/0190483 A1 7/2017 Giraud et al.
2019/0031408 A1 1/2019 Giraud et al.
2019/0270556 A1 9/2019 Patton et al.
2020/0039707 A1 2/2020 Kachian et al.
2021/0221573 A1 7/2021 Salemi

FOREIGN PATENT DOCUMENTS

CN 211418152 U * 9/2020
WO 2018204794 A1 11/2018

OTHER PUBLICATIONS

USPTO, Office Action, dated Nov. 14, 2022.

* cited by examiner

*Primary Examiner* — John K Fristoe, Jr.
*Assistant Examiner* — Eric C Baldrighi
(74) *Attorney, Agent, or Firm* — Ryan Dean; Umberg Zipser LLP

(57) ABSTRACT

Various embodiments of child-resistant containers are described which have a release that requires two portions to be simultaneously depressed in order to release the latches and allow the container to be opened. The release may be formed of two pieces coupled to each other and the housing by a fastener, where one of the pieces acts as a spring to bias the release or its actuators in a first position.

13 Claims, 3 Drawing Sheets

CONTAINER

FIELD OF THE INVENTION

The field of the invention is child-resistant containers.

BACKGROUND

The following description includes information that may be useful in understanding the present invention. It is not an admission that any of the information provided herein is prior art or relevant to the presently claimed invention, or that any publication specifically or implicitly referenced is prior art.

Various types of containers exist in the prior art. While certain of the containers have been designed to be child-resistant, such containers typically comprise a pill bottle for storing medications. These containers can be problematic for storing non-pill products, and the child proof functionality often does not lend itself to other shapes of containers.

Furthermore, many existing child-resistant containers comprise complex mechanisms to release and latch the container that are composed of many parts. This increases the overall cost to manufacture and assemble and can lead to failure of the mechanism over time.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for simplified child-resistant containers having a non-cylindrical shape.

SUMMARY OF THE INVENTION

The inventive subject matter provides apparatus, systems and methods in which a container can comprises a housing that includes first and second pieces that collectively define an interior of the housing. The first and second pieces may be a top piece and a bottom piece, a left piece and a right piece, and so forth. In preferred embodiments, the first and second pieces are hingedly coupled along one side, or otherwise coupled to form a clamshell-like container. However, it is alternatively coupled that the first and second pieces could be slidably connected to one another such that one piece slides from the other piece to reveal an interior of the container.

Contemplated body portions comprise a closed bottom surface having at least one sidewall extending from the bottom surface, which collectively define an interior space of the body portion. The lid portion preferably comprises an upper closed surface having at least one sidewall extending from the surface, and that collectively defines an interior space of the lid portion.

Preferably, the lid portion or body portion comprises a release that when in a first position prevents the container from being opened, and wherein in a second position allows the container to be opened. The release preferably comprises first and second actuators or projections that when simultaneously depressed (a force applied) cause first and second latches to move, thereby permitting the container to be opened. However, the release is configured such that if only one of the first and second actuators or projections are depressed, the release does not fully actuate, and the container cannot be opened.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
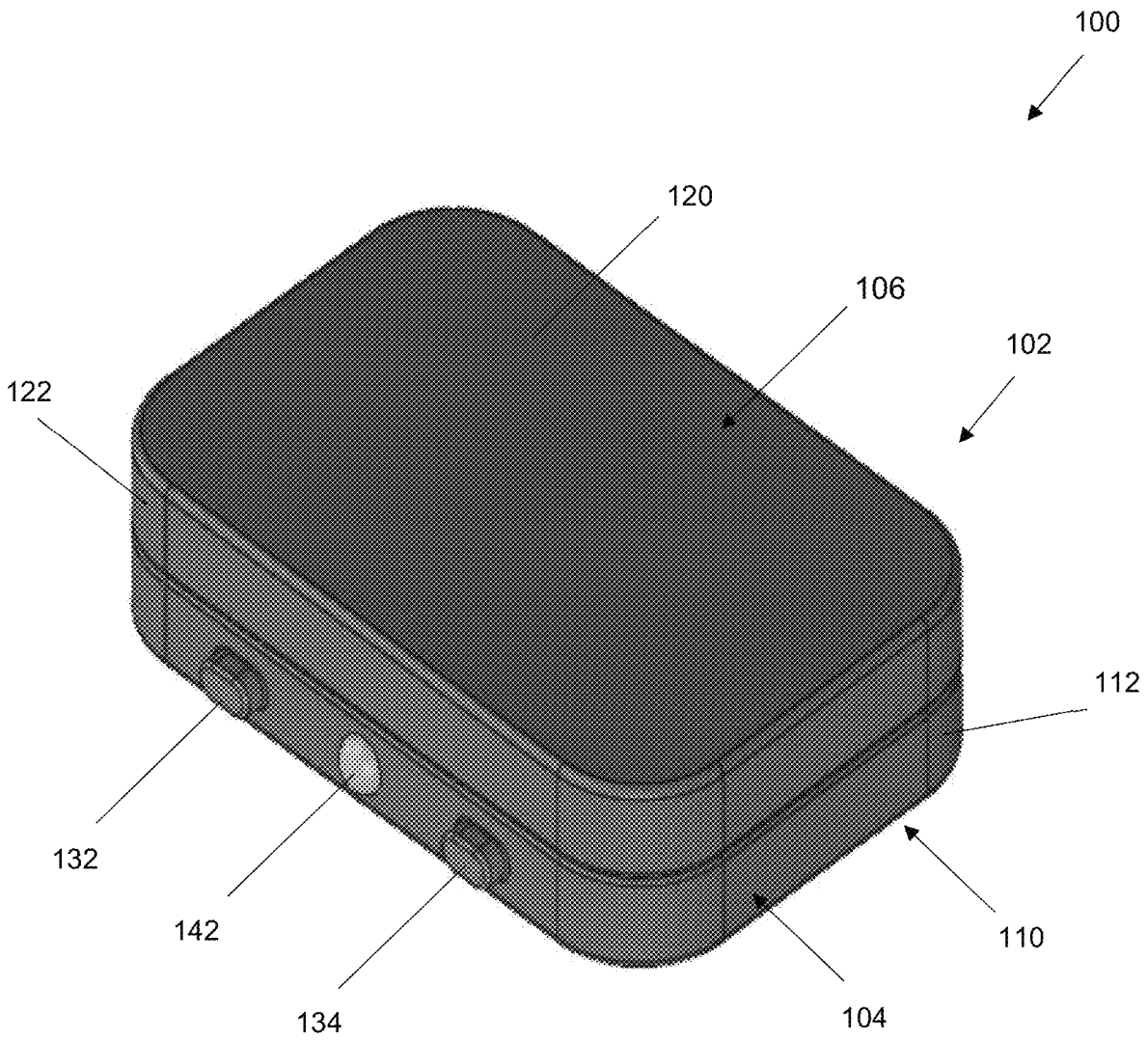
FIG. 1 illustrates a perspective view of one embodiment of the container.
Figure 2:
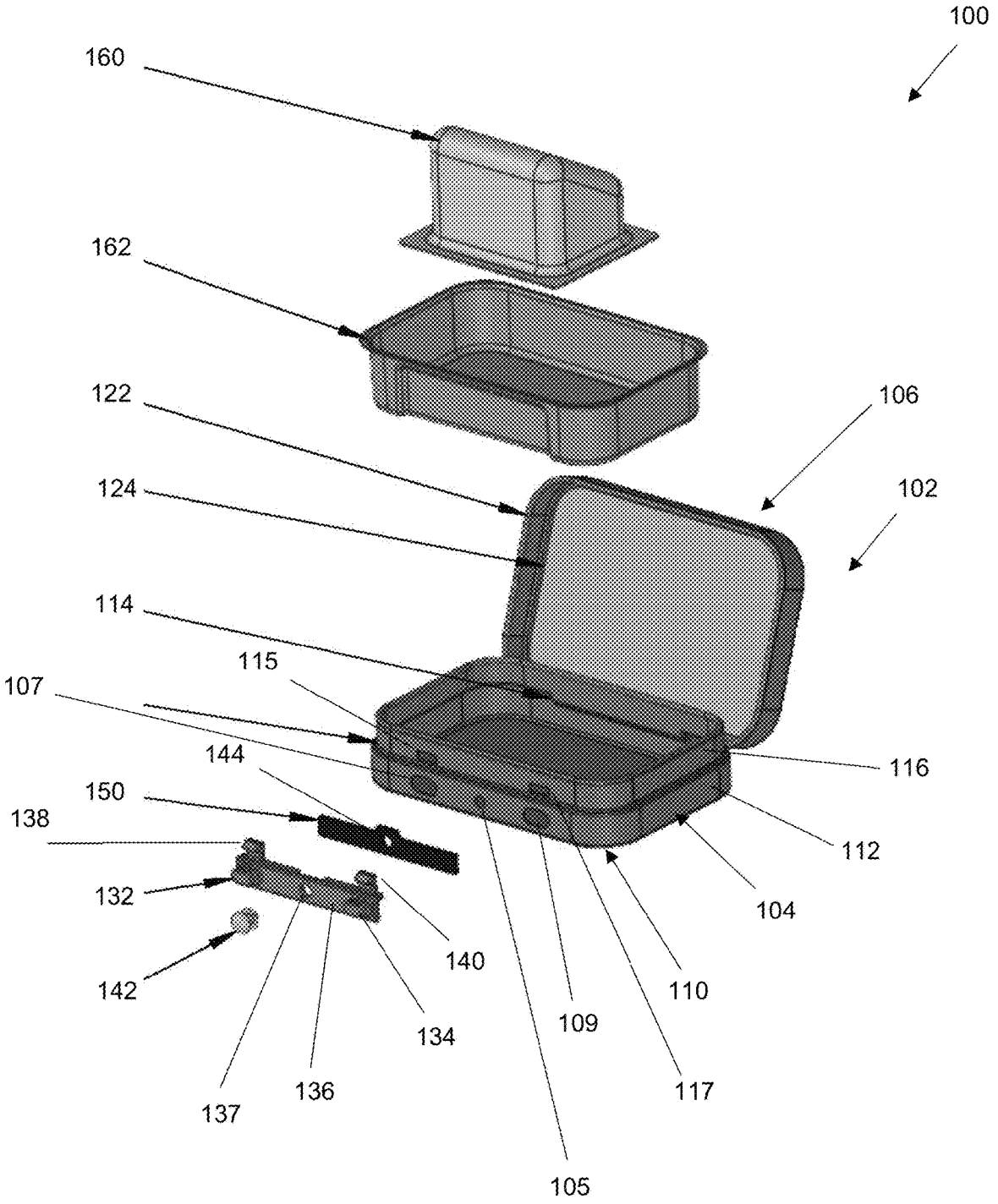
FIG. 2 illustrates an exploded view of the container of FIG. 1.
Figure 3:
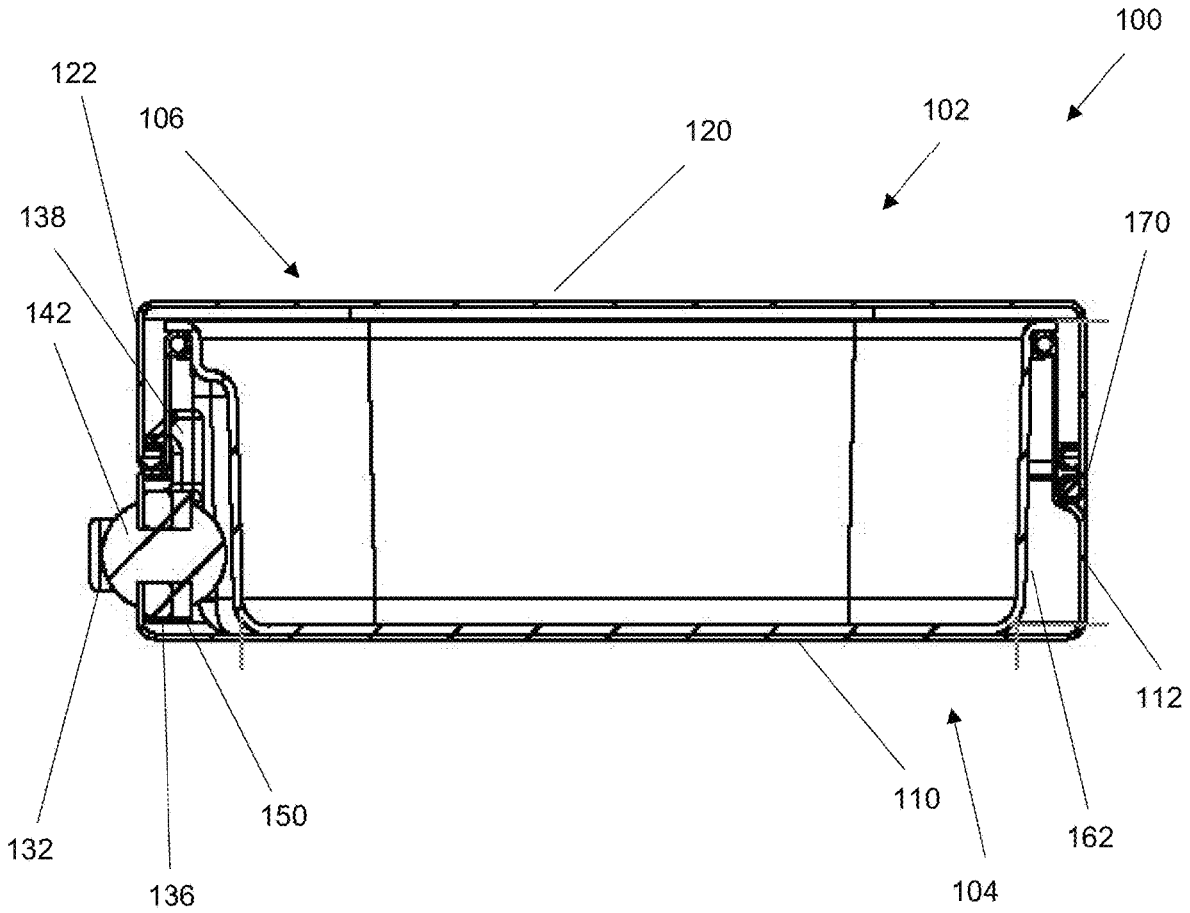
FIG. 3 illustrates a cross-sectional view of the container of FIG. 1.

FIGS. 1-3 illustrate one embodiment of a container 100 having a generally rectangular shape although other shapes are contemplated without departing from the scope of invention herein. Although shown with rounded corners, it is contemplated that the container could alternatively have non-rounded corners. Container 100 is preferably composed of metal or metal composite; however, it is alternatively contemplated that the container 100 could be composed of plastic or other polycarbonates or other commercially suitable material(s) or combinations thereof.

Container 100 comprises a housing 102 that includes a first piece 104 coupled to a second piece 106 that collectively enclose an interior space when the container 100 is closed as shown in FIG. 1. Although not explicitly shown in FIG. 1, the first piece 104 is preferably hingedly coupled to the second piece 106 along the side opposite of the release mechanism. The hinge 170 advantageously permits the second piece 106 to be rotated from a closed configuration shown in FIG. 1 where the second piece 106 is secured on top of the first piece 104 to an open configuration shown in FIG. 2. In some embodiments, the first and second pieces 104, 106 are composed of metal or metal composites, although any commercially suitable material(s) could be used.

The first piece 104 or body portion preferably comprises a closed, bottom surface 110 and at least one sidewall 112 extending upwardly from the bottom surface 110. Collectively the bottom surface 110 and at least one sidewall 112 can at least partially define a hollow interior 114 of the first piece 104. Preferably, the first piece 104 comprises a generally rectangular or other non-cylindrical shape.

A lip or projection 116 preferably extends from the at least one sidewall 112 such that the at least one sidewall 112 and the lip or projection 116 form a step and the lip or projection 116 covers only a portion of a top surface of the at least one sidewall 112.

The second piece 106 or lid portion preferably comprises a closed, top surface 120 and at least one sidewall 122 extending downwardly from the top surface 120. Collectively the top surface 120 and at least one sidewall 122 can at least partially define a hollow interior 124 of the second piece 106. Preferably, the second piece 106 comprises a generally rectangular or other non-cylindrical shape that matches the shape of the first piece 104.

The hollow interior 114 and hollow interior 124 collectively form the interior space of the container 100.

It is contemplated that when the second piece 106 is disposed on top of the first piece 104, the at least one sidewall 122 of the second piece 106 can be disposed about the lip or projection 116.

Container 100 further comprises a release 130 having a first actuator 132 and a second actuator 134. The first actuator 132 is configured to extend through aperture 107 in the sidewall 112 of the first piece 104 to allow the first actuator 132 to be actuated by pushing on the first actuator 132 when the container 100 is closed. The second actuator 134 is configured to extend through aperture 109 in the sidewall 112 of the first piece 104 to allow the second actuator 134 to be actuated by pushing on the second actuator 134 when the container 100 is closed. Preferably, the first actuator 132 is spaced apart from the second actuator 134 by a distance such that it is difficult for children's fingers to depress both actuators 132, 134 simultaneously. Preferred distances are between 25 mm-35 mm or more.

Each of the first and second actuators 132, 134 is configured to move or flex from a first position shown in FIG. 1 to a second position in which the actuator is depressed into the container 100 when a force is applied. Each of the first and second actuators 132, 134 is configured to return to the first position when the force is no longer applied. Each of the first and second actuators 132, 134 has a first surface extending away from the housing 102 (shown in FIG. 1) and a second surface disposed within the housing 102.

It is especially preferred that the first actuator 132 is connected to the second actuator 134 by a connector 136 to which each of the first and second actuators 132, 134 is attached or connected. The connector 136, the first actuator 132 and the second actuator 134 form a single integral piece that is preferably injection molded. As shown in FIG. 2, the first actuator 132 is disposed at a first portion of the connector 136 and extends from a first surface of the connector 136 and the second actuator 134 is disposed at a second portion of the connector 136 and extends from the first surface of the connector 136.

A first latch 138 is coupled to the first actuator 132 and the connector 136. In some embodiments, the first latch 138 is disposed above the first actuator 132 and is configured to be inserted into an aperture 115 in the lip or projection 116 of the first piece 104.

A second latch 140 is coupled to the second actuator 134 and the connector 136. In some embodiments, the second latch 140 is disposed above the second actuator 134 and is configured to be inserted into an aperture 117 in the lip or projection 116 of the first piece 104.

It is contemplated that the first and second latches 138, 140 could be composed of polypropylene or other plastic materials. However, any commercially suitable material could be used that is strong enough to inhibit the container from being opened when the actuators 132, 132 are not depressed.

In this manner, when in a first position, each of the first and second latches 138 and 140 are configured to be inserted through respective apertures 115 and 117 of the lip 116 and interact with a surface (catch) of the second piece 106 to thereby maintain a position and orientation of the first piece 104 relative to the second piece 106 and prevent the second piece 106 from being lifted from the first piece 104. Thus, the second piece 106 cannot be removed from the first piece 104 due to the upper portion of the latches 138, 140 interact with the catch of the second piece 106. Although any number of latches could be used, it is preferred that two or more latches are used to ensure the container remains closed.

Because the first latch 138 is coupled with the first actuator 132, actuation of the first actuator 132 causes the first latch 138 to move with the first actuator 132 and release the catch of the second piece 106. Similarly, actuation of the second actuator 134 causes the second latch 140 to move with the second actuator 134 and release the catch of the second piece 106. In this manner, only when the first latch 138 and the second latch 140 are released simultaneously (due to simultaneous actuation of the first and second actuators 132, 134) can the second piece 106 be lifted from the first piece 104 to open the container 100.

FIG. 2 illustrates an exploded view of the container 100 shown in FIG. 1 and shows the container 100 in an open position that permits access to the interior space of the container 100.

As shown, release 130 can be disposed within the first piece 104, such that actuators 132, 134 each can be disposed at least partially through an opening in the sidewall 112 of the first piece 104. The release 130 comprises left and right sides or first and second portions, with the left side comprising actuator 132 and the first latch 138, and the right side comprising actuator 134 and the second latch 140.

A flexible or semi-flexible piece or bar 150 can be disposed behind the connector 136 and the actuators 132, 134 (and adjacent to the second surface of each of the first and second actuators 132, 134 that is opposite the first surface) and act as a spring that biases each of the actuators 132, 134 in the first position (shown in FIG. 1) in which each of the actuators 132, 134 extends outwardly through the respective openings in the first piece 104. Preferably, the piece 150 comprises a metal piece that has at least some flexibility or resilience to return to its original shape (first position) after being flexed or bent by one or both of the actuators 132, 134 to a second position. Piece 150 may comprise a spring steel or other metal or could be composed of any commercially suitable material(s), such that the piece 150 can be flexed or moved without deforming when one or both of the actuators 132, 134 pushes against the piece 150 and then return to a first position when forced is released from the actuators 132, 134.

At least one fastener 142 can be used to couple the single integral piece (formed of connector 136, actuators 132, 134, and latches 138, 140) and the piece or bar 150 to the first piece 104 of the housing 102. As such, the fastener 142 is configured to be inserted through aperture 137 of the connector 136, aperture 144 of the bar 150, and aperture 105 in the sidewall 112 of the first piece 104. The fastener 142 acts to maintain a position of the release 130 relative to the first piece 104, while also maintaining the relative position of the bar 150 to each of the actuators 132, 134, such that the bar 150 can act as a spring to bias the actuators 132, 134 in the first position.

In some embodiments, container 100 can optionally include an insert 160 configured to be disposed within the first piece 104 of housing 102 covering the portion of release 130 within the interior. A support piece 162 may also be included depending on the contents to be stored within the container 100.

Although the embodiment of the container 100 described above contemplates the release 130 being disposed on the first piece 104, it is alternatively contemplated that release 130 could alternatively be disposed on the second piece 106.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A container, comprising:

a housing having first and second pieces that couple together to enclose an interior space;

wherein the first piece has a non-cylindrical shape, wherein the first piece comprises a closed, bottom surface and at least one sidewall extending upwardly from the closed, bottom surface to at least partially define a first hollow interior;

wherein the second piece has a non-cylindrical shape, wherein the second piece comprises a closed, bottom surface and at least one sidewall extending upwardly from the closed, bottom surface to at least partially define a second hollow interior;

wherein the first and second hollow interiors define the interior space; and a release comprising:

first and second actuators each configured to move from a first position to a second position, wherein each of the first and second actuators has a first surface extending away from the housing and a second surface disposed within the housing; a first latch coupled to the first actuator, and configured to prevent the first and second pieces from being separated when the first actuator is in the first position;

a second latch coupled to the second actuator, and configured to prevent the first and second pieces from being separated when the second actuator is in the first position;

wherein the connector, the first actuator, the second actuator, the first latch and the second latch form a single integral piece;

a metal piece disposed adjacent to the second surface of each of the first and second actuators, such that actuation of the first or second actuators causes the metal piece to bend from a first position to a second position; and wherein the metal piece biases the first and second actuators in the first position.

2. The container of claim 1, wherein the release is mounted to the first piece of the housing, and wherein each of the first and second latches is configured to prevent the second piece from being moved from the first piece when the first or second actuator is in the first position.

3. The container of claim 1, wherein the release is mounted to the second piece of the housing, and wherein each of the first and second latches is configured to prevent the first piece from being moved from the second piece when the first or second actuator is in the first position.

4. The container of claim 1, wherein the first and second pieces are hingedly coupled to one another.

5. The container of claim 1, further comprising a fastener configured to couple the single integral piece and the metal piece to the housing.

6. The container of claim 1, further comprising a fastener configured to couple the single integral piece and the metal piece to the housing.

7. The container of claim 1, wherein the single integral piece is injection molded.

8. The container of claim 1, wherein the metal piece functions as a spring to bias the first and second actuator in the first position.

9. The container of claim 1, wherein the release is actuated to allow the first and second piece to move relative to one another when the first and second actuators are depressed simultaneously, and wherein the release is not actuated when only one of the first and second actuators is depressed.

10. The container of claim 1, wherein each of the first and second actuators is configured to move or flex inwardly toward the interior space of the container when a force is applied, and wherein the first piece and second piece can be released from one another when each of the first and second actuators moves or flexes inwardly which moves the first and second latches, respectively.

11. A child-resistant container, consisting essentially of:

a housing having a body portion and a lid portion that couple together to enclose an interior space;

wherein the body portion has a rectangular shape, wherein the body portion comprises a closed, bottom surface and at least one sidewall extending upwardly from the closed, bottom surface to at least partially define a first hollow interior;

wherein the lid portion has a rectangular shape, wherein the lid portion comprises a closed, top surface and at least one sidewall extending downwardly from the closed, top surface to at least partially define a second hollow interior;

wherein the first and second hollow interiors define the interior space;

a hinge that connects the body portion with the lid portion; and a release comprising:

an actuator having first and second projections connected by a center piece disposed between the first and second projections, where each of the first and second projections extend outwardly from the housing;

a first latch coupled to the first projection such that movement of the first projection causes movement of the first latch;

a second latch coupled to the second projection such that movement of the second projection causes movement of the second latch;

wherein the first and second projections, the first and second latches, and the center piece form a single, injection-molded piece;

a bar disposed within the housing such that a portion of the bar is disposed behind each of the first and second projections, wherein movement of the first projection causes the bar to bend or flex and wherein movement of the second projection causes the bar to bend or flex, and wherein the bar biases the first and second projections in a first position;

a fastener configured to couple the single, injection-molded piece and the bar to the housing.

12. The container of claim 11, wherein the bar comprises a spring metal.

13. The container of claim 11, wherein the release is mounted to the body portion or the lid portion, and wherein each of the first and second latches is configured to prevent opening of the container when either the first or second actuator is in the first position.

* * * * *